United States Patent [19]

Lasley et al.

[11] Patent Number: 4,995,560

[45] Date of Patent: Feb. 26, 1991

[54] PAINT HOSE EXTENSION FOR ELECTROSTATIC SPRAY GUN

[75] Inventors: Charles T. Lasley, Toledo; James J. Gimple, Oregon, both of Ohio

[73] Assignee: Illinois Tool Works, Inc., Glenview, Ill.

[21] Appl. No.: 381,573

[22] Filed: Jul. 18, 1989

[51] Int. Cl.[5] ..... B05B 5/02

[52] U.S. Cl. ..... 239/708; 239/691; 239/706; 118/629

[58] Field of Search ..... 239/691, 690.1, 704, 239/706, 707, 708, 3; 118/629

[56] References Cited

U.S. PATENT DOCUMENTS

| | | | |
|---|---|---|---|
| 2,739,838 | 3/1956 | Sedlacsik | 118/629 |
| 2,784,350 | 3/1957 | Sedlacsik . | |
| 2,926,106 | 2/1960 | Gauthier . | |
| 3,747,850 | 7/1973 | Hastings et al. . | |
| 3,791,579 | 2/1974 | Cowan . | |
| 3,794,243 | 2/1974 | Tamny et al. | 239/707 |
| 3,896,994 | 7/1975 | Walberg . | |
| 3,929,286 | 12/1975 | Hastings et al. . | |
| 3,930,061 | 12/1975 | Scharfenberger . | |
| 3,934,055 | 1/1976 | Tamny . | |
| 4,139,155 | 2/1979 | Hastings . | |
| 4,629,119 | 12/1986 | Plunkett et al. . | |

*Primary Examiner*—Andres Kashnikow
*Assistant Examiner*—Christopher G. Trainor
*Attorney, Agent, or Firm*—MacMillan, Sobanski & Todd

[57] ABSTRACT

A paint hose extension to facilitate safe application of metallic paints with a hand held electrostatic spray gun. The hose extension extends between the spray gun and a hose connected to a grounded paint supply. The hose extension provides a predetermined long electrically insulated paint flow path between a high voltage paint charging electrode in the spray gun and the paint supply hose. An electrically conductive layer shields the hose between an electrically grounded handle on the spray gun and a remote metallic connector which attaches to the paint supply hose. The connector electrically connects the conductive layer with the grounded paint column at the connector.

7 Claims, 2 Drawing Sheets

PAINT HOSE EXTENSION FOR ELECTROSTATIC SPRAY GUN

TECHNICAL FIELD

The invention relates to electrostatic paint spray guns and more particularly to a paint hose extension for an electrostatic paint spray gun which grounds the paint stream being delivered to the spray gun at a location spaced a predetermined distance from the spray gun, making the spray gun suitable for applying metallic paints.

BACKGROUND ART

When applying paint with a hand held electrostatic paint spray gun, it is desirable to electrically ground the spray gun body to protect the operator from risk of electrical shock. It also is desirable to electrically ground the paint supply to prevent current from flowing from the paint charging electrode at the spray gun front through the paint column to electrically charge the entire paint supply. If the paint supply is isolated from ground and becomes charged, the operator is at risk of receiving a shock when the paint source is replenished or otherwise serviced. For electrically non-conductive paints, the paint column supplied to the gun typically flows through a supply hose to a connector attached to the base of a spray gun handle. A short length of hose is attached between this connector and either the nozzle or the barrel of the spray gun. Although the paint supply hose may be attached directly to the barrel or to the nozzle, supporting the paint supply hose from the handle provides better balance than if the supply hose is attached only to the nozzle or to the adjacent end of the barrel. By attaching the connector to the spray gun handle, the connector is grounded along with the handle. Thus, the paint column flowing to the gun is grounded both at the gun and at the supply. Not only is the operator protected from electrical shock when the entire paint column from the source to the gun is grounded, but the risk of a rupture, a cut or a pin hole break in the paint supply hose allowing a spark from the paint column to ground is eliminated since there is no charge on the paint column. If the paint column were charged and a spark should occur, there is a risk that flammable paint solvents could ignite or explode.

Problems occur when attempting to apply metallic paints with a hand held electrostatic spray gun. The problems result from the short electrical path between the high voltage paint charging electrode at the spray gun nozzle and the normal ground connection to the gun handle. For metallic paints, the high voltage gradient over the short path may cause the metallic particles in the paint to align. This can sufficiently short circuit the high voltage to ground to prevent adequate charging of the atomized paint.

It has been recognized in the prior art that electrically conductive paints can be applied with an electrostatic applicator and with the remote paint source grounded by providing a sufficiently long paint column between the ground point and the paint charging electrode at the spray gun. In U.S. Pat. No. 2,784,350, for example, a length of non-conductive fluid supply hose is formed into a helical coil by wrapping around an insulated support. The coil increases the length of the electrical path from the paint charging electrode to the grounded source. In U.S. Pat. No. 4,139,155, a similar coil is mounted in a cartridge which is attached to the spray gun between the spray gun barrel and a grounded paint supply connector at the lower end of the spray gun handle. This arrangement is effective for lengthening the electrical path between the high voltage paint charging electrode and ground while maintaining the paint column between the gun handle and the supply at ground potential. Thus, the tendency of the metallic flakes to align and tc short out the high voltage is reduced and the operator is still protected against the risk of electrical shock in the event that the paint supply hose should break or develop a leak. However, the paint cartridge significantly increases the weight at the barrel of the spray gun, since not only is the weight of the cartridge located between the gun handle and the end of the barrel, but also the weight of the column of paint in the cartridge is present in the cartridge. The added weight to the end of the spray gun adversely affects the balance of the gun and also increases operator fatigue.

DISCLOSURE OF INVENTION

According to the invention, a paint hose extension is attached between an electrostatic paint spray gun and the paint supply hose to safely increase the length of the electrical path through the paint column from a high voltage paint charging electrode in the gun and ground. The hose extension facilitates application of metallic paints without increasing electrical shock risks for the spray gun operator. The hose extension does not adversely affect the balance of the spray gun nor does it add significantly to the weight of the spray gun and attached hoses.

The paint hose extension is attached at one end through an electrically conductive connector to a conventional paint supply hose and adjacent the other end is attached through an electrically conductive adapter to the lower end of the spray gun handle. An electrically insulating fluid hose extends from either the spray gun barrel or the nozzle coaxially through the adapter to the remote connector on the end of the hose extension to provide a ground insulated paint flow path from the remote connector to the high voltage paint charging electrode in the spray gun. The insulated tube is shielded with a grounded electrically conductive layer between the adapter attached to the spray gun handle and the remote connector. The ground path from the paint charging electrode through the paint column is increased while a grounded conductive layer surrounds the insulated paint column between the spray gun handle and the remote connector. Thus, the paint column is electrically grounded both at the paint supply and the remote connector which is a predetermined distance from the high voltage electrode. In the event that the paint hose extension should break or rupture, the surrounding grounded conductive layer protects the operator from risk of electrical shock and the risk of a spark causing a fire or an explosion is reduced. The paint hose extension increases the length of the insulated paint column with no significant increase in the weight of the spray gun or the attached paint supply hose and without adversely affecting the balance of the spray gun. At the same time, a sufficiently long path is provided from the paint charging electrode through the paint to ground to allow the paint to be charged as it is atomized.

Accordingly, it is an object of the invention to provide improved means for increasing the length of the paint column between a high voltage paint charging electrode in an electrostatic paint spray gun and a grounded paint supply while maintaining operator safety.

Other objects and advantages of the invention will be apparent from the following detailed description and the accompanying drawings.

BEST MODE FOR CARRYING OUT THE INVENTION

Figure 1:
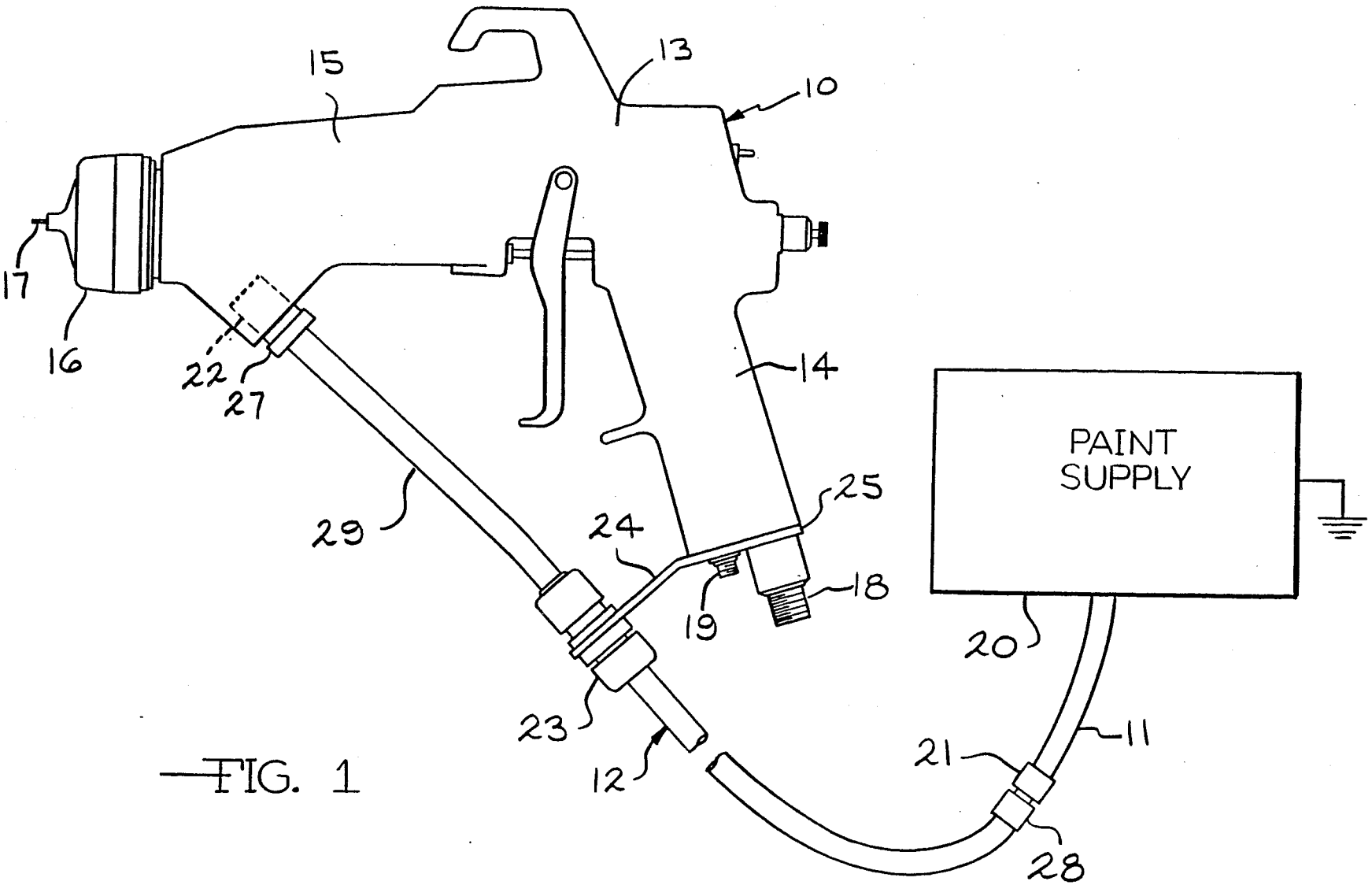
FIG. 1 is a diagrammatic view of a hand held electrostatic paint spray gun connected through a paint hose extension according to the invention to a grounded pressurized source of paint.

Turning now to FIG. 1 of the drawings, a hand held electrostatic paint spray gun 10 is shown attached to a paint supply hose 11 by means of a paint hose extension 12 according to the invention. The spray gun 10 may be of any conventional design and typically will include a body 13, a handle 14, a barrel 15 and a nozzle 16. Together, the barrel 15 and the nozzle 16 form an assembly for receiving and atomizing paint or other material to be sprayed. A paint charging electrode 17 may project from the nozzle 16 or may be confined within the nozzle 16 for imparting an electrostatic charge to the atomized paint. For operator safety, the handle 14 and preferably also the body 13 are formed from an electrically conductive material, such as a conductive plastic or metal, and are electrically grounded. If the spray gun 10 requires compressed air for atomization of the paint and/or for shaping the pattern of the paint spray, compressed air is supplied from a suitable external source (not shown) attached to a connector 18 on the spray gun handle 14.

Electrical power is applied to the spray gun 10 from a suitable remote source (not shown) connected through a wire (not shown) to a connector 19 on the handle 14. The electrical connection to the connector 19 also electrically grounds the spray gun handle 14 and all attached electrically conductive components. Depending on the spray gun design, high voltage dc, an intermediate voltage ac or a low voltage dc may be supplied to the spray gun 10. If high voltage dc is supplied to the gun 10, the voltage is applied through a large value safety resistor (not shown) in the barrel 15 to the electrode 17. If an intermediate voltage ac is supplied to the spray gun 10, this voltage is rectified and stepped up to a high voltage dc in a known manner by means of a network (not shown) of capacitors and diodes located in the spray gun 10. If low voltage dc is supplied to the spray gun 10, the spray gun 10 will have an internal power supply for converting the low voltage to a high voltage dc for charging the paint.

The paint supply hose 11 is connected to a conventional pressurized paint source, represented by a block 20. The paint source 20 may, for example, consist of a tank containing a volume of paint. The tank is connected to a conventional source of compressed air (not shown) to pressurize the tank to cause the paint to flow from the source 20 to the spray gun 10. According to the invention, the paint may be a metallic paint. Of course, the spray gun 10 also may be used to apply electrically non-conductive materials. However, when non-conductive paints are applied with the spray gun 10, there is no need for the paint hose extension 12. The metallic paint typically contains flakes of metal. The paint may be non-conductive so long as the metallic flakes are maintained in a fairly uniform suspension. However, if the metallic flakes are subjected to the forces of a high voltage over a short distance, they sometimes tend to align and to form an electrically conductive path having a sufficiently low resistance to ground the high voltage. For operator safety, it is preferable to electrically ground the paint source 20. This is particularly important when applying metallic paints.

A hose connector 21 is attached to the end of the paint supply hose 11. For spraying non-conductive paints, the hose connector 21 may be attached directly to the spray gun 10. In such case, the supply hose 11 preferably would be supported from the spray gun handle 14 to improve the balance and ease of operation of the spray gun 10. According to the invention, for spraying metallic paints, the hose extension 12 is inserted between the paint supply hose connector 21 and the threaded opening 22 in the spray gun barrel 15. The hose extension 12 provides an electrically non-conductive path of a predetermined length between the high voltage electrode 17 in the nozzle 16 and the grounded paint column at the connector 21. The hose extension 12 includes an adapter 23 which is attached through an electrically conductive metallic bracket 24 to the lower end 25 of the handle 14 for supporting the hose extension 12 from the spray gun handle 14 to maintain the balance of the spray gun 10. The hose extension 12 does not exert a significantly greater force on the spray gun handle 14 than the force exerted by the paint supply hose 11 when the hose 11 is attached directly to the spray gun 10.

Figure 2:
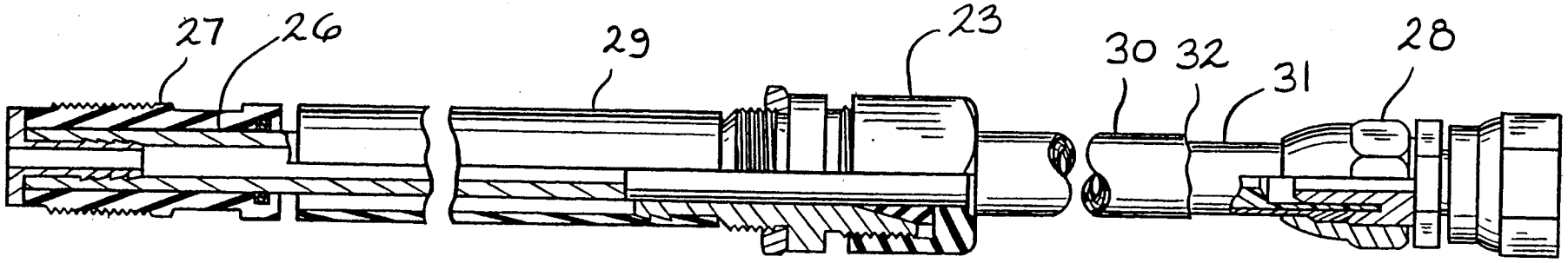
FIG. 2 is a side elevational view, in partial section, of the paint hose extension of the invention.

Referring now to both FIGS. 1 and 2, details are shown for the paint hose extension 12. The hose extension 12 includes an electrically insulated tube 26, preferably of polyethylene, extending between a male connector 27 of a size for engaging the threaded barrel opening 22 and a female connector 28 of a size for receiving the paint supply hose connector 21. The connectors 27 and 28 are of conventional design. The tube 26 is of a length selected to provide a predetermined length electrically insulated path between the paint charging electrode 17 and the connector 21 on the paint supply hose 11. For example, a tube 26 on the order of 50 inches, or about 125 centimeters, in length has been found useful for applying many metallic paints with an electrostatic spray gun 10. The tube 26 extends coaxially through and is supported by the adapter 23. Between the connector 27 and the adapter 23, the tube 26 is preferably surrounded by a second insulated tube or sleeve 29. The sleeve 29 protects the otherwise exposed portion of the tube 26 from damage and also protects the operator from risk of shock in the event that the tube 26 should rupture or develop a pin hole leak between the connector 27 and the adapter 23.

The portion 30 of the hose extension 12 between the adapter 23 and the connector 28 includes two additional layers. An electrically conductive layer 31 covers the exterior of the tube 26 through the portion 30. The conductive layer may be made by any known technique and material, provided that it does not significantly interfere with the flexibility of the hose 26 and does not add too much to the weight of the hose 26. The conductive layer 31 may be, for example, either an extruded or a braided layer of electrically conductive nylon, preferably having a resistance of not more than 5,000 ohms per lineal foot of the hose extension 12. A protective polyurethane sheath 32 is extruded over the conductive layer 31 to protect the conductive layer 31 from abrasion. The adapter 23 and the connector 28 are attached to the tube 26 to be in electrical contact with the conductive layer 31. As a consequence, the conductive layer 31 establishes an electrical ground connection between the spray gun handle 14, by means of the conductive bracket 24 and the adapter 23, and the paint column in the supply hose 11, by means of the connector 28 through which the paint column flows. At the same time, the hose extension 12 provides an insulated path for the paint column between the connector 28 and the paint charging electrode 17 in the spray gun nozzle 16.

In the event that the paint hose extension 12 should rupture or develop a pin hole leak in the portion 30 during operation of the spray gun 10, the escaping paint will immediately come into contact with the grounded conductive layer 31. As a consequence, the operator is protected from risk of shock. Also, if a flammable paint is being sprayed, the escaping paint will be immediately grounded by the conductive layer 31 as the paint flows from the hole or break with minimum risk of a spark which could cause a fire or an explosion.

Although preferred materials for the tube 26, the conductive layer 31 and the sheath 32 have been given, other suitable materials will be apparent to those skilled in the art. The material for the tube 26 will be limited by the paint or other coating material carried by the tube 26 since the tube 26 must be resistant to the solvent for such material. Solvents in certain coating materials, for example, may require the use of a Teflon (polytetrafluoroethylene) tube. It will be appreciated that various modifications and changes may be made to paint hose extension of the invention without departing from the spirit and the scope of the following claims.

We claim:

1. A paint hose extension for insertion between a free end of a paint supply hose and an electrostatic paint spray gun having an electrically grounded handle, a barrel and nozzle assembly for receiving and atomizing paint and a high voltage electrode for imparting an electrostatic charge to the paint, said paint supply hose having a remote end connected to an electrically grounded paint section, said hose extension comprising electrically non-conductive hose means extending between said barrel and nozzle assembly and said paint supply hose for providing a predetermined long electrically insulated paint flow path between said paint supply hose and said barrel and nozzle assembly, means supporting said hose means at said spray gun from said handle, an electrically conductive layer surrounding said hose means between said support means and said paint supply hose, means electrically connecting said conductive layer to said spray gun handle, and means electrically connecting said conductive layer to paint at said free end of said paint supply hose whereby paint in said supply hose is electrically grounded at both ends of aid supply hose.

2. A paint hose extension for connecting a paint supply hose to an electrostatic paint spray gun, as set forth in claim 1, wherein said means electrically connecting said conductive layer to paint in said paint supply hose comprises metallic connector means for connecting said hose means to said paint supply hose, said connector means electrically contacting said conductive layer and electrically contacting paint flowing from said paint supply hose to said hose means.

3. A paint hose extension for connecting a paint supply hose to an electrostatic paint spray gun, as set forth in claim 1, wherein said hose means includes a polyethylene core tube, and wherein said conductive layer comprises a layer of conductive nylon.

4. A paint hose extension for connecting a paint supply hose to an electrostatic paint spray gun, as set forth in claim 3, wherein said conductive layer has a resistance no greater than 5,000 ohms per foot along said hose means.

5. A paint hose extension for connecting a paint supply hose to an electrostatic paint spray gun, as set forth in claim 3, wherein said hose means further includes a polyurethane sheath covering said core tube and said conductive layer between said support means and said paint supply hose.

6. A paint hose extension for connecting a paint supply hose to an electrostatic paint spray gun, as set forth in claim 1, wherein said conductive layer has a resistance no greater than 5,000 ohms per foot along said hose means.

7. A paint hose extension for connecting a paint supply hose to an electrostatic paint spray gun, as set forth in claim 1, and further including an electrically insulating tube surrounding said hose means between said supporting means and said barrel and nozzle assembly.

* * * * *

UNITED STATES PATENT AND TRADEMARK OFFICE

CERTIFICATE OF CORRECTION

PATENT NO. : 4,995,560

DATED : February 26, 1991

INVENTOR(S) : Charles T. Lasley, et al.

It is certified that error appears in the above-identified patent and that said Letters Patent is hereby corrected as shown below:

Column 6, line 11, change "aid" to -- said --.

Signed and Sealed this

Twenty-third Day of June, 1992

*Attest:*

DOUGLAS B. COMER

*Attesting Officer*

*Acting Commissioner of Patents and Trademarks*